United States Patent [19]

Wada et al.

[11] Patent Number: 4,826,558

[45] Date of Patent: May 2, 1989

[54] ELECTRICALLY-OPERATED LABELER

[75] Inventors: Tadafuto Wada, Tokyo; Mituo Fujita, Washimiyamachi, both of Japan

[73] Assignee: Matsushita Electric Industrial Co., Ltd., Osaka, Japan

[21] Appl. No.: 217,041

[22] Filed: Jul. 11, 1988

Related U.S. Application Data

[63] Continuation of Ser. No. 887,923, Jul. 22, 1986, abandoned.

[30] Foreign Application Priority Data

Jul. 26, 1985 [JP] Japan ..... 60-164023

[51] Int. Cl.[4] ..... B65C 11/02

[52] U.S. Cl. ..... 156/384; 101/288; 156/577; 156/579; 156/DIG. 49; 221/73

[58] Field of Search ..... 156/384, 577, 579, DIG. 44, 156/DIG. 48, DIG. 49; 101/258; 221/71, 73

[56] References Cited

U.S. PATENT DOCUMENTS

| | | | |
|---|---|---|---|
| 3,243,574 | 3/1966 | Blythe et al. | 156/579 |
| 4,264,396 | 4/1981 | Stewart | 156/384 |
| 4,407,692 | 10/1983 | Torbeck | 156/384 |

*Primary Examiner*—Michael Wityshyn

*Attorney, Agent, or Firm*—Wenderoth, Lind & Ponack

[57] ABSTRACT

The labeler in accordance with the present invention has an approximately L-shaped housing to which a reversed L-shaped handle is attached and is provided with a keyboard and an input signal display on the vertical part of the housing. The housing incorporates an electrical system for receiving and processing input signals from the keyboard, a label tape roll retainer, an electrical printer for printing necessary information on labels and a mechanism for moving a carrier strip of a label tape. The electric energy for the electrical circuits is supplied to respective electrical circuits from an internal power supply provided inside the handle or an external power supply connected to the handle by a cord.

17 Claims, 14 Drawing Sheets

ELECTRICALLY-OPERATED LABELER

BACKGROUND OF THE INVENTION

The present invention relates to the electrically-operated labeler which is adapted to print directly input print symbols selected on a keyboard onto labels or print them after conversion to bar codes and to separate printed labels from the carrier strip as the carrier strip moves.

This type of electrically-operated labeler incorporates a microprocessor as means for receiving and processing electrical signals and a battery as the power supply as disclosed in the specification of the U.S. Pat. No. 4,264,396.

This labeler is designed so that it can stick each of the printed labels onto each of a plurality of articles while the user holding the labeler at its handle swings the labeler body forward and rearward and therefore an inertia which acts on the housing of the labeler is always applied to the user's hand holding the labeler.

Accordingly, if the housing has a heavy weight, the user will suffer great fatigue in his hands and the efficiency of work will deteriorate.

This type of electrically-operated labeler has required a large capacity battery which has had generally a heavy weight and therefore a problem has appeared that the weight of the housing increases, the work efficiency deteriorates due to the fatigue of the user and the user suffers a kind of disease in his wrists.

Since the electrically-operated labelers are used in most cases for printing bar codes on labels, it has been often requested that users want to obtain a labeler containing the carrier strip with labels on which bar codes are printed. In this case, another printer has been required.

An object of the present invention is to provide a labeler which is provided with an L-shaped housing inside which internal mechanisms are dispersedly arranged in order to reduce the length of the housing in the swinging direction and the magnitude of the centrifugal force caused by inertia.

Another object of the present invention is to provide a labeler whose weight is reduced and whose power source has a large capacity by providing a rechargeable battery with a cord and holding this rechargeable battery in the holder which is designed to be fitted to the user's body.

A further object of the present invention is to provide a labeler in which the attachment which is remountably provided on the housing is driven by a driving means in the housing so that this attachment allows the labeler to be used as a printer.

SUMMARY OF THE INVENTION

The labeler of the present invention has an approximately L-shaped housing and a handle which extends across the free ends of this housing.

The input keyboard and the display unit for displaying input signals from this input keyboard are provided on the outer surface of the operating part which forms the vertical part of said housing and the start switch for operating the electric circuit in said operating part is provided near the handle. The case for incorporating the mechanical part forming the horizontal part of the said housing is provided with a bottom frame with an openable bottom, the label tape holder which is arranged on the bottom frame to wind the carrier strip carrying the labels around said holder, the driving mechanism for feeding the carrier strip around said holder according to a signal from said electrical circuit and the turnback part for turning back said carrier strip to separate a label from the carrier strip while moving it forwardly.

In the first embodiment, said handle incorporates the rechargeable battery to reduce the weight of the housing and inertial force which acts on the housing.

In the second embodiment, said rechargeable battery is connected to the labeler body with the cord and the power battery is held by the user himself to thus reduce the weight of the labeler body.

In the third embodiment, the attachment is remountably provided on the housing. This attachment has the feed roll which comes in contact under pressure with the impression roll of the housing and is adapted to rotate the feed roll by the driving force of the driving mechanism for feeding the carrier strip, thus allowing the labeler to serve as a printer.

DETAILED DESCRIPTION OF THE PREFERRED EMBODIMENT

Figure 1:
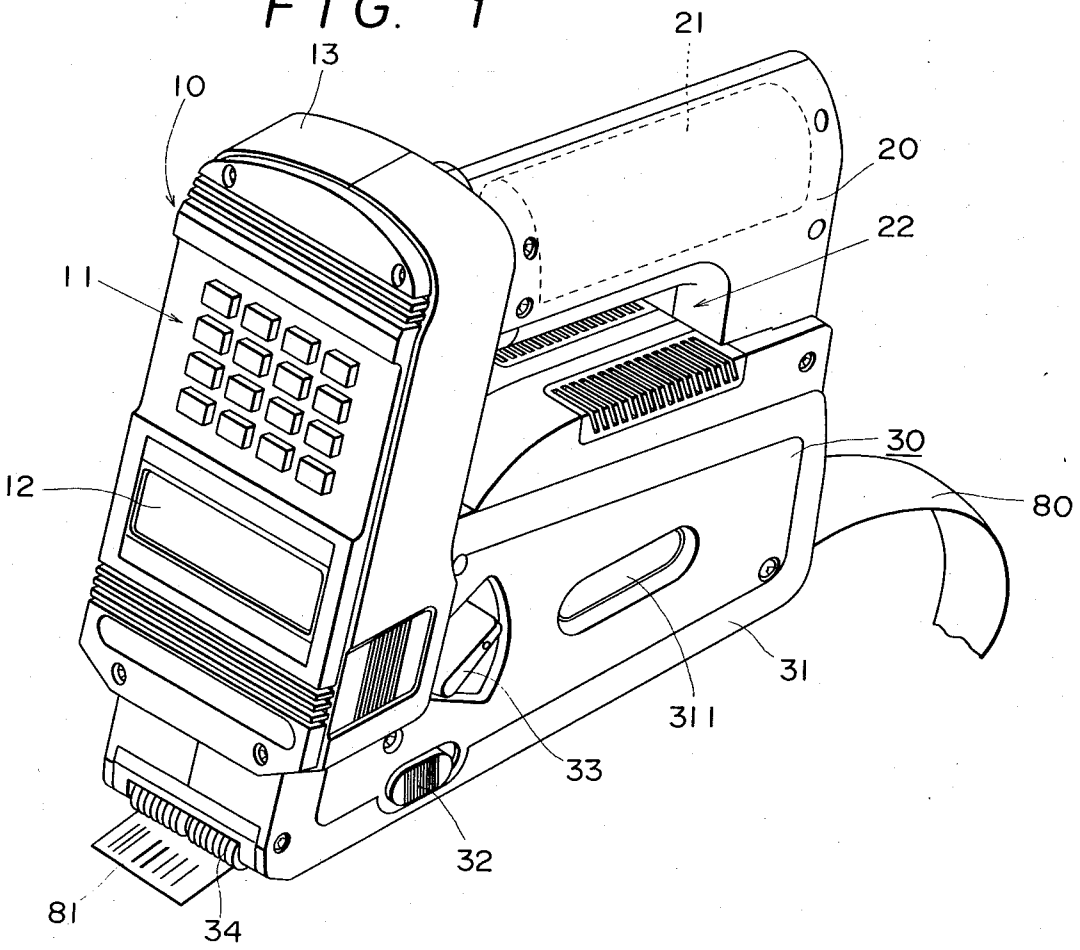
FIG. 1 is a perspective view of the labeler in accordance with the present invention.
Figure 2:
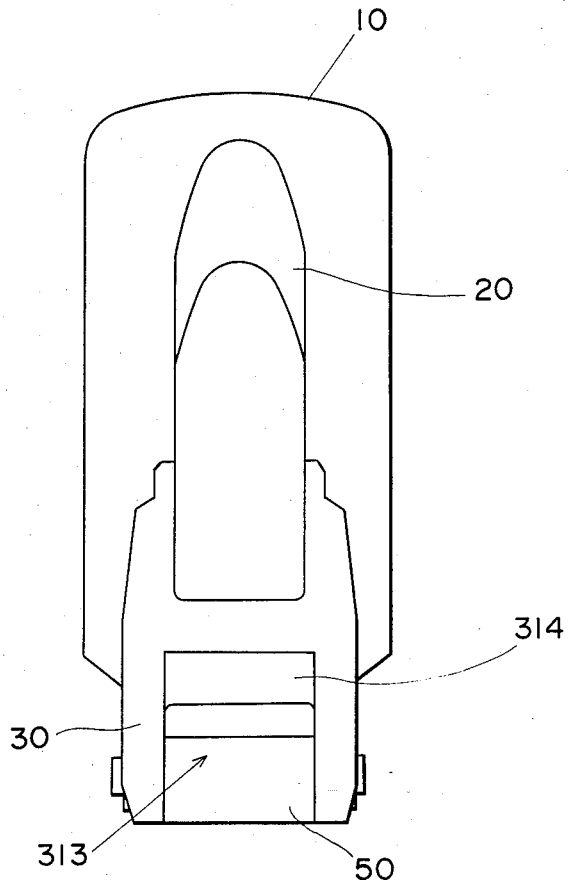
FIG. 2 is a rear view of said labeler.

The labeler in accordance with the present invention has a substantially L-shaped housing which has the normally upright shell portion 10, handle 20 and a normally horizontal casing portion 30 as shown in FIGS. 1 and 2. Upright shell portion 10 contains substantially all of the electrical operating parts, including microswitch 44, while horizontal casing portion 20 includes substantially all of the mechanical operating parts, including support member 42.

Said operating part 10 is provided with the keyboard 11 and the display 12 such as, for example, a liquid crystal panel for displaying the input signals from the keyboard 11, which are arranged on the outer surface of the outer frame 13 of the rectangular operating part 10.

Said handle 20 is extended, for example, at right angles from the rear side of the outer frame 13 toward the end part of the entire labeler and incorporates the power source 21 such as, for example, a rechargeable battery or a set of dry cells.

Said horizontal casing portion 30 is provided at the rear of said shell portion 10 and extends laterally from the lower end of said shell portion, i.e. parallel with said handle 20, and its extended end part is connected with the free end of said handle 20 so as to be, for example, reconnectable, whereby the finger grip opening 22 is formed under the handle 20 by the handle 20, shell portion 10 and casing portion 30. The thickness T of the shell portion is small relative to the length L of the casing portion.

Said casing portion 30 has the casing 31 which is integrated with the outer frame 14 of said shell portion 10 and an approximately L-shaped housing is formed by the outer frame 13 and the casing 31, and there are provided, on said casing 31, a means for opening the bottom frame such as, for example, push button 32, main switch 33, check window 311 for checking the remaining length of label and the impression roll 34 for applying a label. This impression roll 34 is provided on the underside of the base of the casing 31 which is integral with said outer frame 13.

Figure 3:
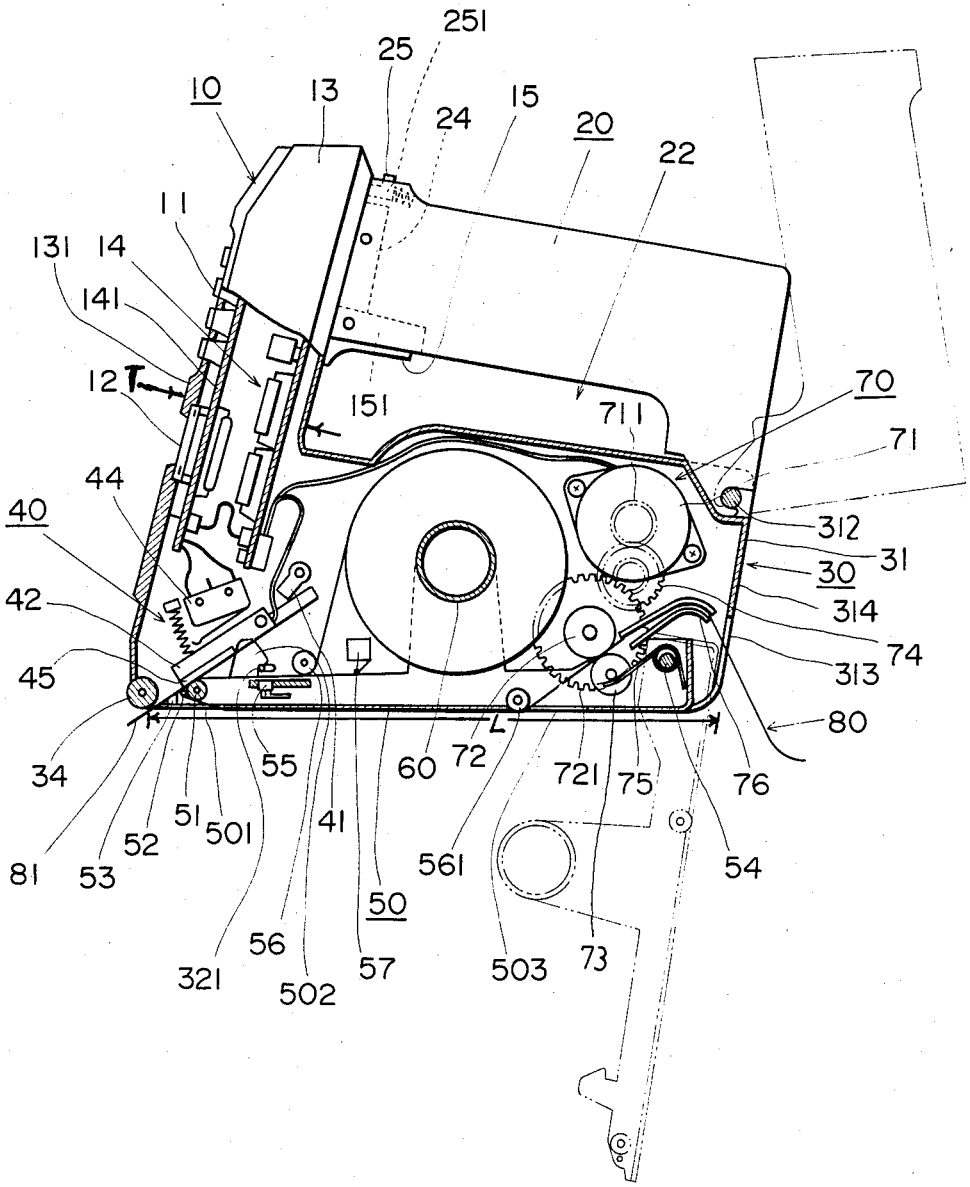
FIG. 3 is a partly cutaway side view showing the principal parts of said labeler.
Figure 4:
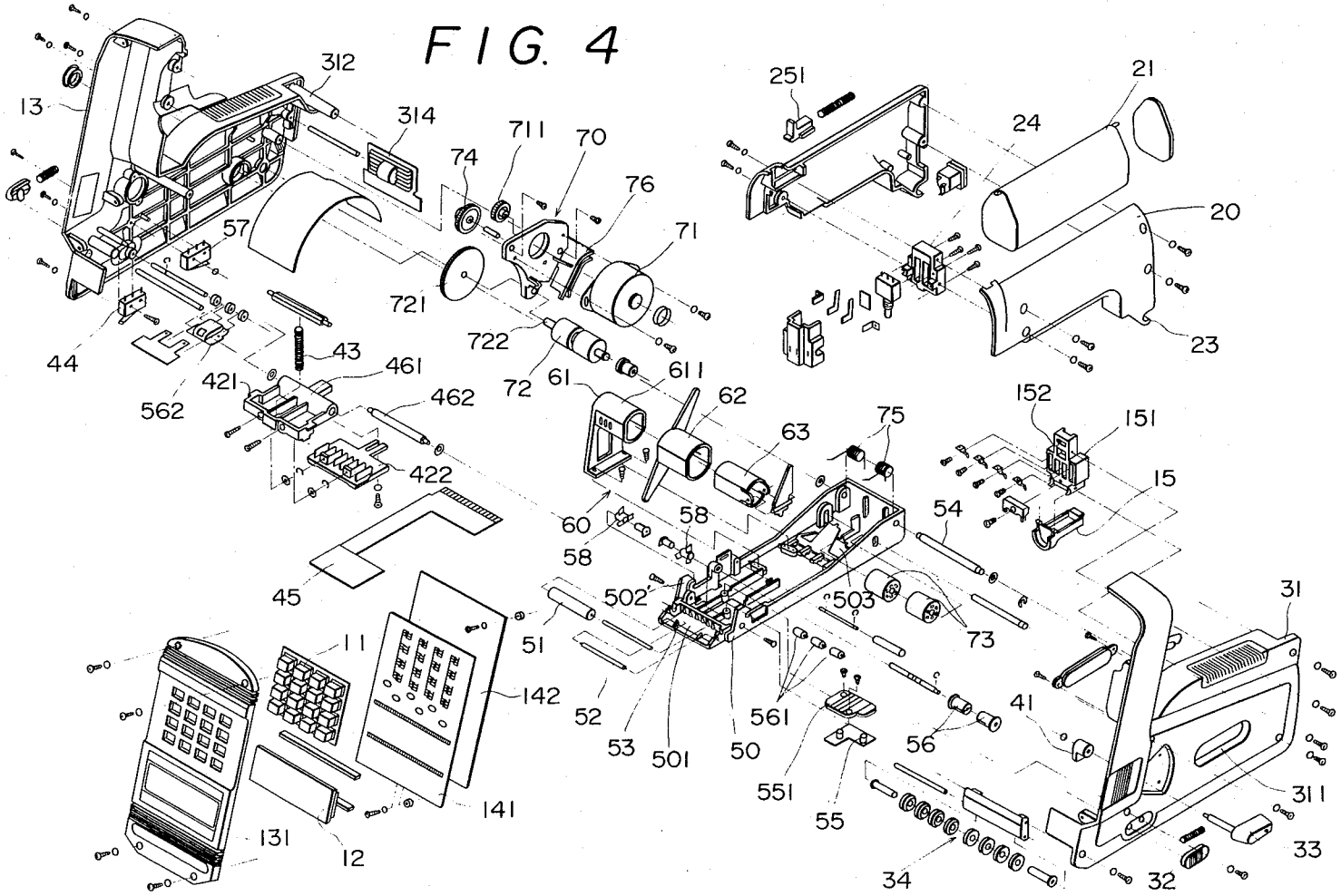
FIG. 4 is an exploded perspective view showing parts of the labeler of the present invention.

Said shell portion 10, as shown in FIGS. 3 and 4, incorporates the electric circuit 14 consisting of printed circut boards 141 and 142 located behind the front panel 131 of the outer frame 13 and is constructed so that an input signal is given to the electric circuit 14 by operating the keys of the keyboard 11, the print symbol obtained by said input signal such as, for example, the numbers indicating the bar codes to be printed are displayed on the display 12 and the label is printed as described later by using the start switch 15. As such electric circuit, the circuit as described in the U.S. Pat. No. 4,264,396 can be used.

Said handle 20 is constructed to be rotatable around the support shaft 312 provided at the outer end of the casing 31 which forms the casing portion 30, for example, as shown by broken lines in FIG. 3 so that the internal rechargeable battery can be charged or replaced by displacing the inside end part of the handle 20 outwardly.

In the embodiment, said handle 20 is constructed to be replaceable as a whole and therefore the engaging part 23 is provided to be disengageable the support shaft 312.

For the above purpose, said shell portion 10 is provided with the start switch 15 along the handle 20, and this start switch 15 is combined with the terminal holder 151 on the shell portion 10 and adapted to operate said electric circuit 14 through the terminal holder 151.

On the other hand, said handle 20 is provided with the connector 24 which is coupled with the terminal holder 151 so that the power supply 21 is connected with the electric circuit 14 when the handle 20 is engaged with the shell portion 10.

Said handle 20 is provided with the lock 25 as shown in FIGS. 3 and 4 and the engaging segment 251 of this lock 25 allows the handle 20 to be fixed to said support shaft 312 as a fulcrum when said engaging segment 251 engages with the engaging part of the outer frame 13, for example, the engaging hole 152 provided on the terminal holder 151.

Said casing portion 30 incorporates the printing device 40, bottom frame 50, label tape holder 60 and drive mechanism 70, and the label tape holder 60 retains the label tape roll or a roll of carrier strip 80 with a number of labels 81 consecutively stuck thereon. Said printing device 40 is provided inside the casing 31 near said impression roller 34 as shown in FIGS. 3 to 7 and comprises the cam 41 which operates in conjunction with said main switch 33, support member 42 which is released by said cam 41 when the printing is carried out and turned in a direction where it is moved away from the label 81 or turned up as viewed on FIG. 5 when the printing is stopped, spring 43 which always forces the support member 42 onto the label 81, microswitch 44 which is actuated to close to close the electric circuit 14 when said support member 42 turns toward the label 81 or it is released from the cam 41 and actuated to open by said support member 42 to open the electric circuit 14 when said support member 42 is turned against spring 42 by the cam 41 or it is moved away from the label 81, thermal head 45 such as, for example, a thermo-graphic printing head which prints a bar code corresponding to the input signal from said keyboard 11 in accordance with operation of said start switch 15 when said electric circuit 14 is closed, and bearing device 46 which bears support member 42.

Figure 5:
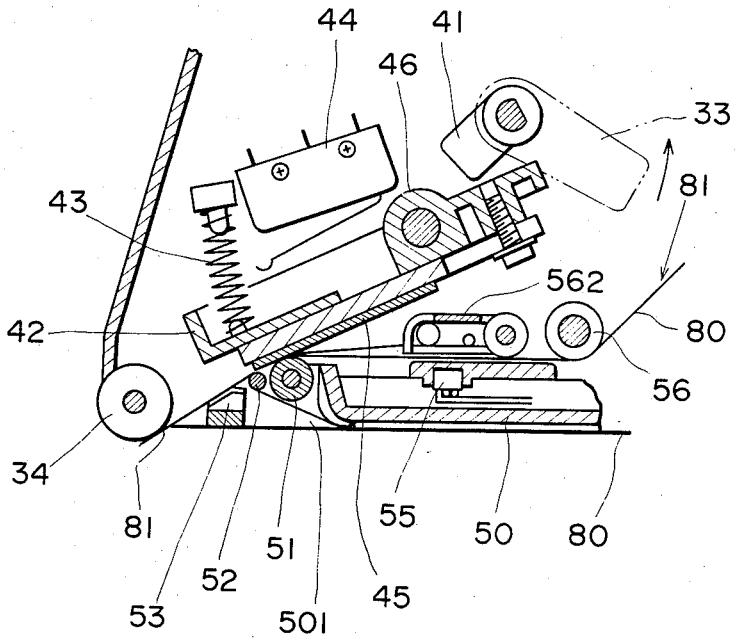
FIG. 5 is an enlarged partial sectional side view showing the printing device of said labeler.

Said cam 41 is constructed to operate in conjunction with the main switch 33 as described above so that it releases the support member 42 when the main switch is at the active position as shown with a broken line in FIG. 5 and it turns counterclockwise as viewed in FIG. 5 to cause the support member 42 to turn against the spring 43 when the main switch 33 rotates to the inactive position.

In the present embodiment, accordingly, the surface of the platen roller 51 located on the bottom frame 50 can be prevented from being deformed because there is pressure contact with the thermal head 45 only when the thermal head 45 performs printing.

Figure 6:
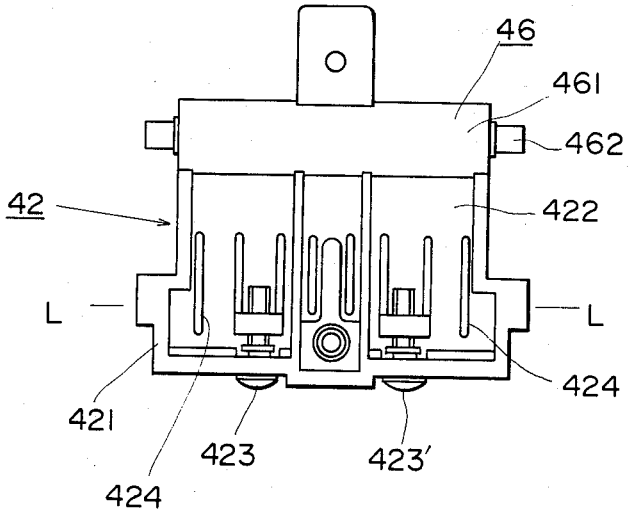
FIG. 6 is a plan view showing the support frame of the printing device of said labeler.

Said support member 42 has the frame member 421 and the frame plate 422 which is fitted into said frame member 421 as shown in FIGS. 3 and 6. Said thermal head 45 is provided on the surface of said frame plate 422 opposed to the label, and said frame plate 422 and the frame member 421 are connected by a pair of coupling screws 423 and 423' which are set at right angles to the axial line L of said platen roller 51 and can be adjusted in accordance with the tightness of this pair of screws 423 and 423' so that the heat generation part of said thermal head 45 is positioned on the axial line of the platen roller 51.

Moreover, said frame plate 422 is made of a material with high heat conductivity and is designed to radiate heat generated from the thermal head 45 through the heat radiation plates 424.

Figure 7:
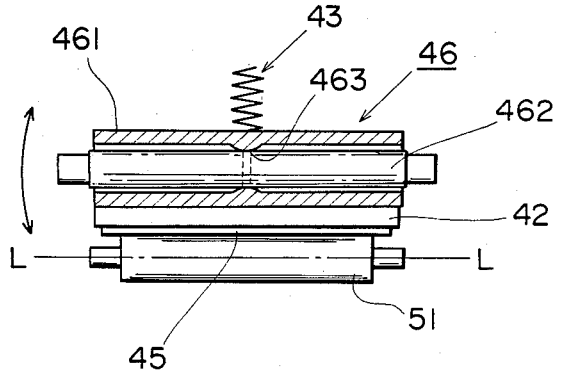
FIG. 7 is a crosssectional view illustrating the bearing mechanism of the printing device of said labeler.

Said bearing device 46 is provided to form the rotation fulcrum for said support member 42. In the embodiment, said bearing device 46 is provided with the bearing hole 461 formed in the rear part of said support member 42, shaft 462 inserted into said bearing hole 461 and the swinging fulcrum provided on one of said shaft 462 or the internal wall of the bearing hole 461 such as, for example, the annular projection 463 provided on the internal wall of the bearing hole as shown in FIG. 7. The bearing device 46 is formed so that said bearing hole 461 or said support member 42 can be swung at said swing fulcrum in the direction of the arrow around the shaft 462.

In this embodiment, therefore, said support member 42 can make the thermal head accurately contact said platen roller 51 to ensure accurate printing with uniform darkness.

Said bottom frame 50 is provided with the platen roller 51, which contacts under pressure said thermal head 45 through the label 81, at the turnable end as shown in FIGS. 3 to 5 and the label separating member such as, for example, the small diameter pin 52 for turning back the carrier strip 80 is provided in front of the platen roller 51. Moreover, the label guide segment 53 provided in the front of the space 501 and the space 501 form the turnable end of the bottom frame, and the turnable end of the bottom frame having the label guide segment 53 is turned as shown by the broken lines in FIG. 3 and the rear end of the bottom frame is pivoted on the pivotal shaft 54 on the casing 31 to open the bottom side of the casing 31 and returned to close the bottom side of the casing 31 as shown by the solid lines in FIG. 3. This bottom frame 50 is constructed to be locked shut and released so as to be opened by said push button 32 and therefore is provided with engaging members 502 and 502' which are engaged with and disengaged from the engaging segment 321 of the push button 32 by operating the push button 32.

In the embodiment, the engaging segment 321 is fixed to the push button 32 and designed so that the engaging segment 311 retracts when engaged by the slanting edges of the engaging members 502 and 502' and is forced by the spring (not shown) to engage with the engaging members 502 and 502' when the bottom frame 50 is closed, and the bottom frame 50 can be released by passing the push button 32 to slide the engaging segment 321 against the spring.

The bottom frame 50 is provided with a sensor means for detecting the position of the label such as, for example, the position sensor 55 employing a photo-electron conversion element, which is supported by the support plate 551. Said drive mechanism 70 is controlled by this sensor 55 so that the label 81 can accurately contact the thermal head 45.

Figure 8:
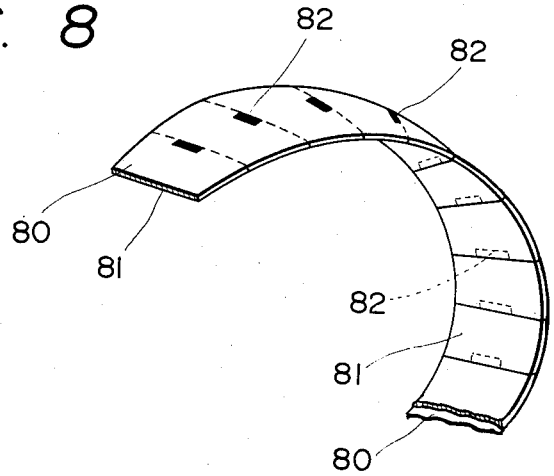
FIG. 8 is a perspective view showing the rear surface of the carrier strip for use in the labeler of the present invention.

For the above purpose, the detection marks 82 are printed at given intervals on the rear surface of said carrier strip 80 as shown in FIG. 8 and the drive control signal is transmitted to the electric circuit 14 when said sensor 55 detects one of these marks 82.

After having been turned back around said pin 52, said carrier strip 80 is forwarded along the external surface of the bottom frame 50, led into the frame body through the window 503 formed in the bottom frame 50 and intermittently fed by the drive mechanism 70.

Moreover, said bottom frame 50 is provided with guiding means such as an appropriate number of guide rollers 56 capable of adjusting the width of the guide surface in accordance with the width of label, guide rollers 561 provided near the window 503 of the bottom frame and the tape retainer 562 arranged on the upper surface of the bottom frame and with a detector switch 57 for checking the closure of the bottom frame 50 at the casing 31.

Said detector switch 57 is connected, for example, in series with said microswitch 44 and designed so that the electric circuit 14 does not operate if the bottom frame is not closed completely.

Figure 9:
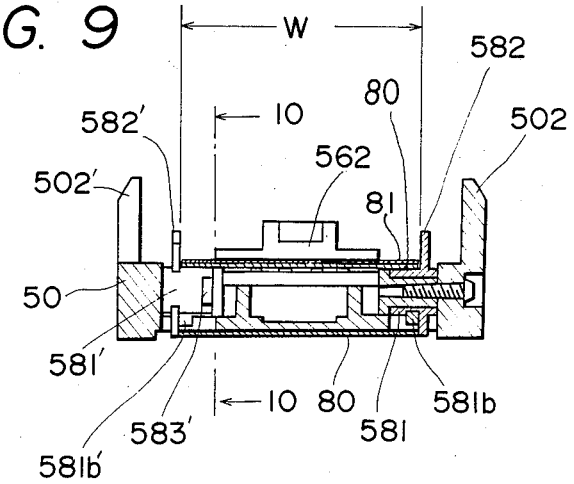
FIG. 9 is a sectional front view of the principal part of the bottom frame for use in the labeler of the present invention, showing the label tape guide provided on the bottom frame.
Figure 10:
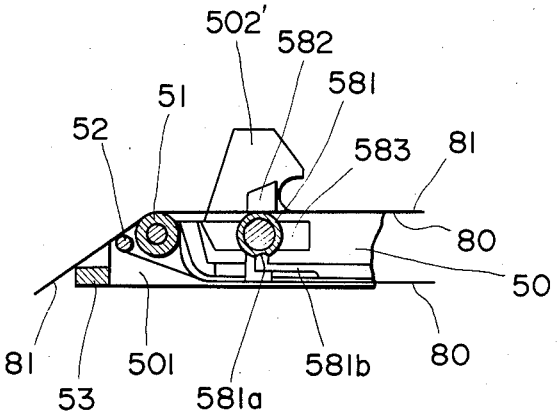
FIG. 10 is a crosssectional view taken along line 10—10 in FIG. 9, showing the principal part of the bottom frame of said labeler.
Figure 11:
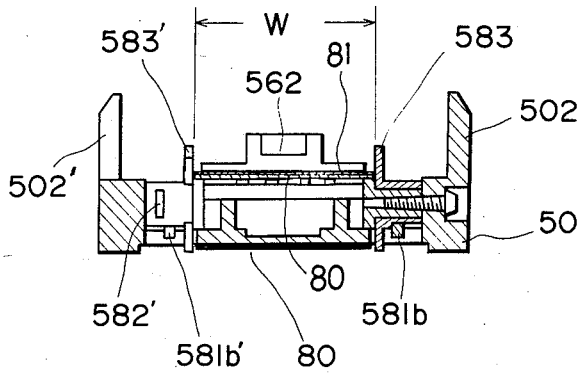
FIG. 11 is a crosssectional view showing the state of deformation of the label tape guide shown in FIG. 9.

Said bottom frame 50 is provided with the label tape guide 58 as shown in FIG. 4 and FIGS. 9 to 11 and this guide 58 is provided with wheels 581 and 581' internally at both sides of the bottom frame 50 as shown in FIGS. 9 and 10. The wheels 581 and 581' are respectively provided with two stoppers 582 and 583 and with two stoppers 582' and 583' which extend in orthogonal directions so that these stoppers are arranged at specified intervals and adapted so that the width W between stoppers is increased as shown in FIG. 9 when the outer stoppers 582 and 582' are in the upright position and decreased as shown in FIG. 11 when the inner stoppers 583 and 583' are in the upright position. For securing the positions of these stoppers, said wheels 581 and 581' are provided with engaging notches **581*a* ans 581*a'* at 90-degree intervals so that the elastic engaging members 581*b* and 581*b'* extended from the bottom frame 50 engages with the respective engaging notches 581*a* and 581*a'* as shown in FIG. 10**.

Accordingly, in this embodiment, the label tape guide 58 can be adjusted to match two kinds of labels with different width. Furthermore, said bottom frame 50 is provided with the label tape holder 60 as shown in FIG. 4 and FIGS. 12 to 15, and the carrier strip 80 onto which a number of labels 81 are stuck consecutively in order is wound around this label tape holder 60, turned back around the pin 52 through said label tape guide 58, extended along the external surface of the bottom frame 50 and fed into the casing through the window 503.

This label tape holder 60 is designed so that its width can be varied in accordance with two kinds of labels having different widths on said label tape guide 58.

For the above purpose, the label tape holder 60 consists of the bearing support 61 which is fixed to the bottom frame 50 and provided with the sleeve 611 extending in the direction across the bottom frame 50, outer sleeve 62 which is mounted on the sleeve 611 of said bearing support 61 and inner sleeve 63 which is inserted into the sleeve 611 of said bearing support 61, and said sleeve 611 is provided with two engaging holes 612 and 613 in its axial direction.

Said outer sleeve 62 is provided with the tape retainer 621 on its side and projection 622 which alternatively engages with said engaging holes 612 and 613 on its internal surface, and said internal sleeve 63 is provided with the tape retainer 631 on its side and the projection 632 which alternatively engages with said engaging holes 612 and 613 on its external surface.

Figure 12:
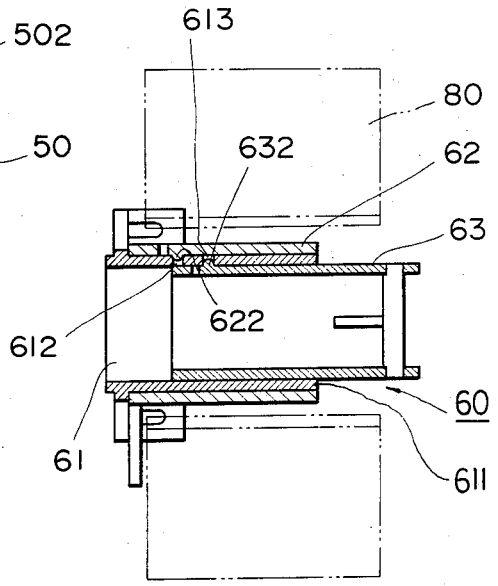
FIG. 12 is a horizontal sectional view of the label tape holder of the labeler of the present invention.
Figure 13:
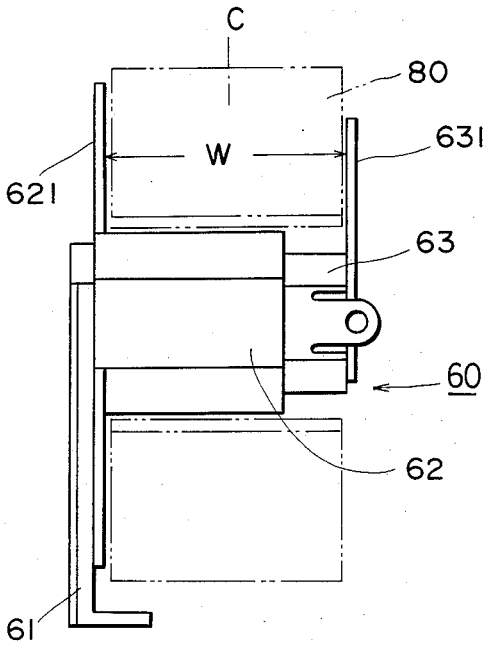
FIG. 13 is a front view of said label tape holder shown in FIG. 12.
Figure 14:
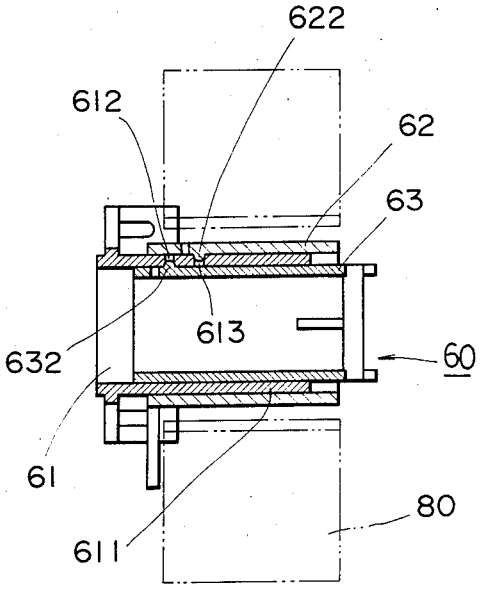
FIG. 14 is a horizontal plan view in section showing the state of deformation of the label tape holder of said labeler.

According to the present embodiment, if the projection 622 of the external sleeve 62 engages with the outside engaging hole 612 and the projection 632 of the internal sleeve 63 engages with the inside engaging hole 613 as shown in FIGS. 12 and 13, the width W between a pair of label retainers 621 and 631 is increased and, if the projection 622 of the external sleeve 62 engages with the inside engaging hole 613 and the projection 632 of the internal sleeve 63 engages with the outside engaging hole 612, the width W between a pair of label holders 621 and 631 is decreased.

In this embodiment, since the width W between label retainers is varied in accordance with equal movement of internal and external sleeves 62 and 63 in the axial directions thereof, it is effective to keep the position of center line C of the width W stationary and the center of the printing position relative to the label 81 is always kept fixed.

Figure 15:
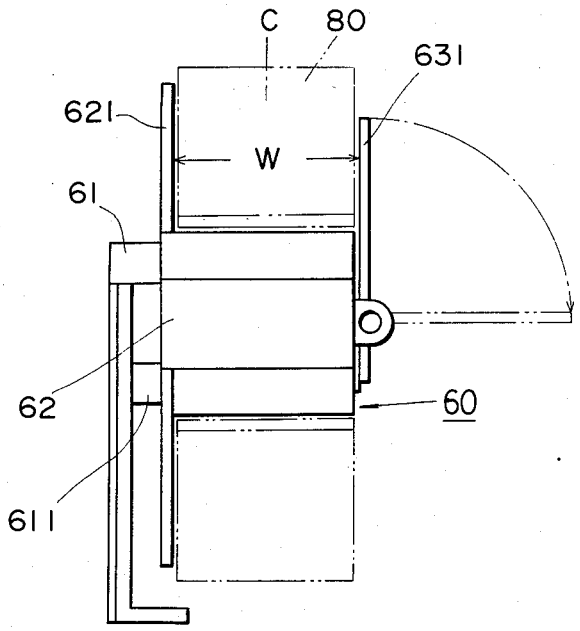
FIG. 15 is a front view of said label tape holder shown in FIG. 14.

Said label tape holder 60 retains the rolled label tape consisting of the carrier strip 80 and labels stuck thereon which is secured on the external sleeve 62 and the rolled label tape can be mounted on the external sleeve 62 by turning the tape retainer 631 of the internal sleeve 63 outwardly as shown by the broken lines in FIG. 15.

Inside the casing 31 of said mechanical part 30, there are provided the motor 71 which is driven by the electric circuit 14 and the feed roll 72 which is rotated by said motor 71, while said bottom frame 50 incorporates the drive mechanism 70 combined with the impression roll 73 which contacts under pressure with the feed roll 72 when the bottom frame is closed, and the carrier strip 80 inserted through the window 503 is fed by the drive mechanism 70. In the embodiment, the reduction gear 74 is provided between the feed roll 72 and the motor 71 of this drive mechanism 70 and arranged so that it is positioned between the gear 721 of the feed roll 72 and the drive gear 711 of the motor 71. The shaft 722 of said feed roll 72 is constructed so that it can be connected to an external attachment through the coupling hole formed in the casing 31.

Moreover, said impression hole 73 is given the impression power by the spring 75 provided on the bottom frame 50. This spring 75 is used to force the bottom frame 50 in the open direction and, accordingly, the bottom frame 50 is caused to protrude outside the casing 31 by the spring 75 when the bottom frame 50 is released by operating push button 32.

Moreover, the feedout guide 76 for the carrier strip 80 is provided inside said casing 31, and the carrier strip 80 is fed out of the opening 313 of the casing 31 through the feedout guide 76 while being forwarded by the feed roll 72 and the impression roll 73 and cut as required by the cutter 314 provided at the feedout opening 313.

Said carrier strip 80 is printed with the detection mark 82 on its rear surfaces as described above and carries a number of labels 81 made of, for example, a heat sensing paper which are stuck in sequence on the surface of the carrier strip 80. Said carrier strip 80 is fed a specified length when the motor 71 is driven with the control signal obtained from said detection mark 82 and the bar code selected, for example, by the keyboard 11 is printed on labels by the thermal head 45 while the carrier strip 80 is fed the specified length.

The attachment 90 for the printer as shown in FIGS. 16 to 20 is considered an external attachment to be connected to the shaft 722 of the feed roll 72 in said drive mechanism 70.

Figure 18:
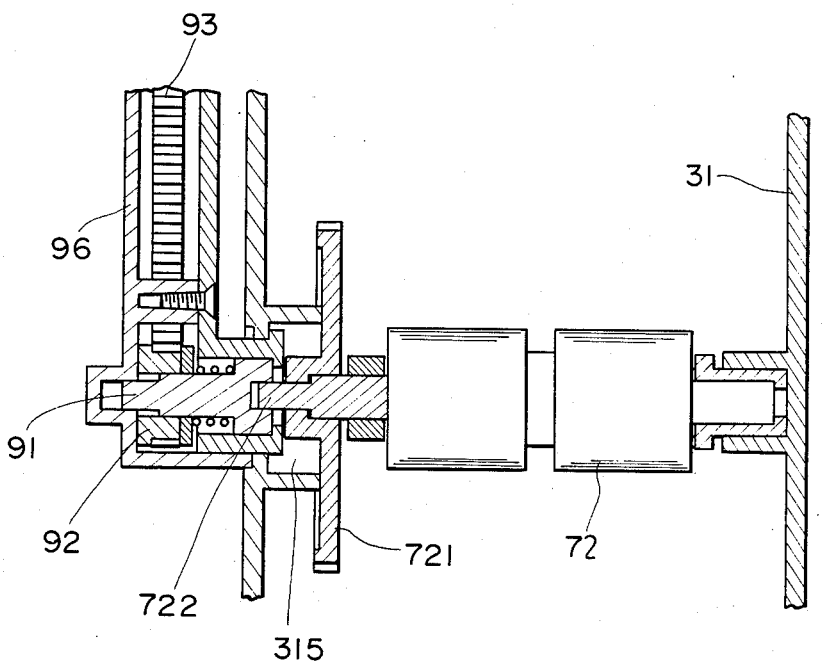
FIG. 18 is a crosssectional view showing the principal parts of the labeler shown in FIG. 16.
Figure 20:
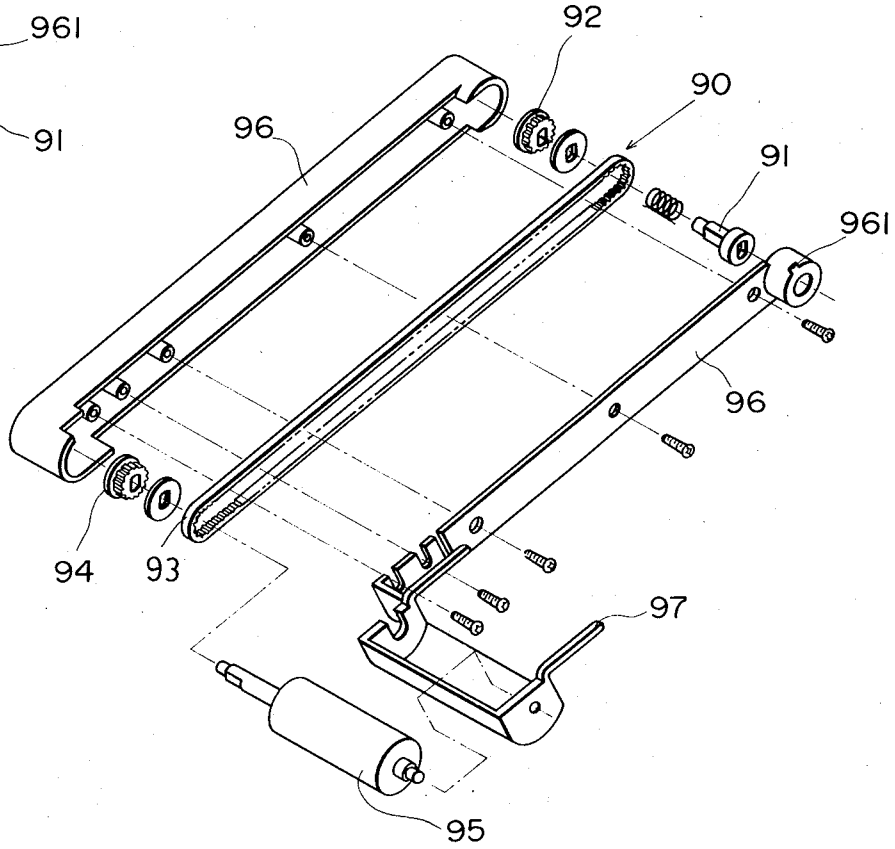
FIG. 20 is an exploded perspective view of the attachment of FIG. 19.
Figure 19:
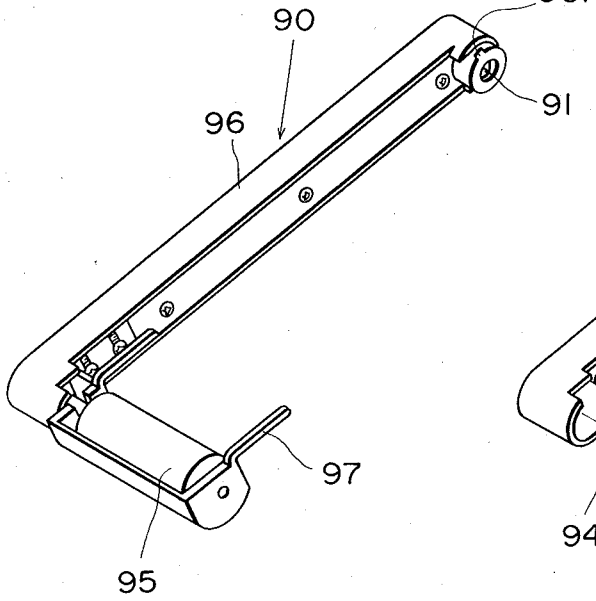
FIG. 19 is a perspective view of the attachment for use in the labeler shown in FIG. 16.

This attachment 90, as shown in FIGS. 18 to 20, has the bearing hub 91 to be coupled with the shaft 722 of said feed roll 72, the general pulley 92 engaged with said bearing hub 91, the geared belt 93 to be turned around said pulley 92, the geared pulley 94 at the receiving end to be rotated by said belt 93, the feed roll 95 to be rotated by rotation of said pulley 94 and the mounting case 96 which contains said parts and depresses under pressure the feed roll 95 against said impression roll 34, and said mounting case 96 is provided with, for example, the extension member 97 which is inserted into the casing 31 of the casing portion 30 and secured by the bottom frame 50 and constructed to be thus fixed to the casing 31.

Figure 17:
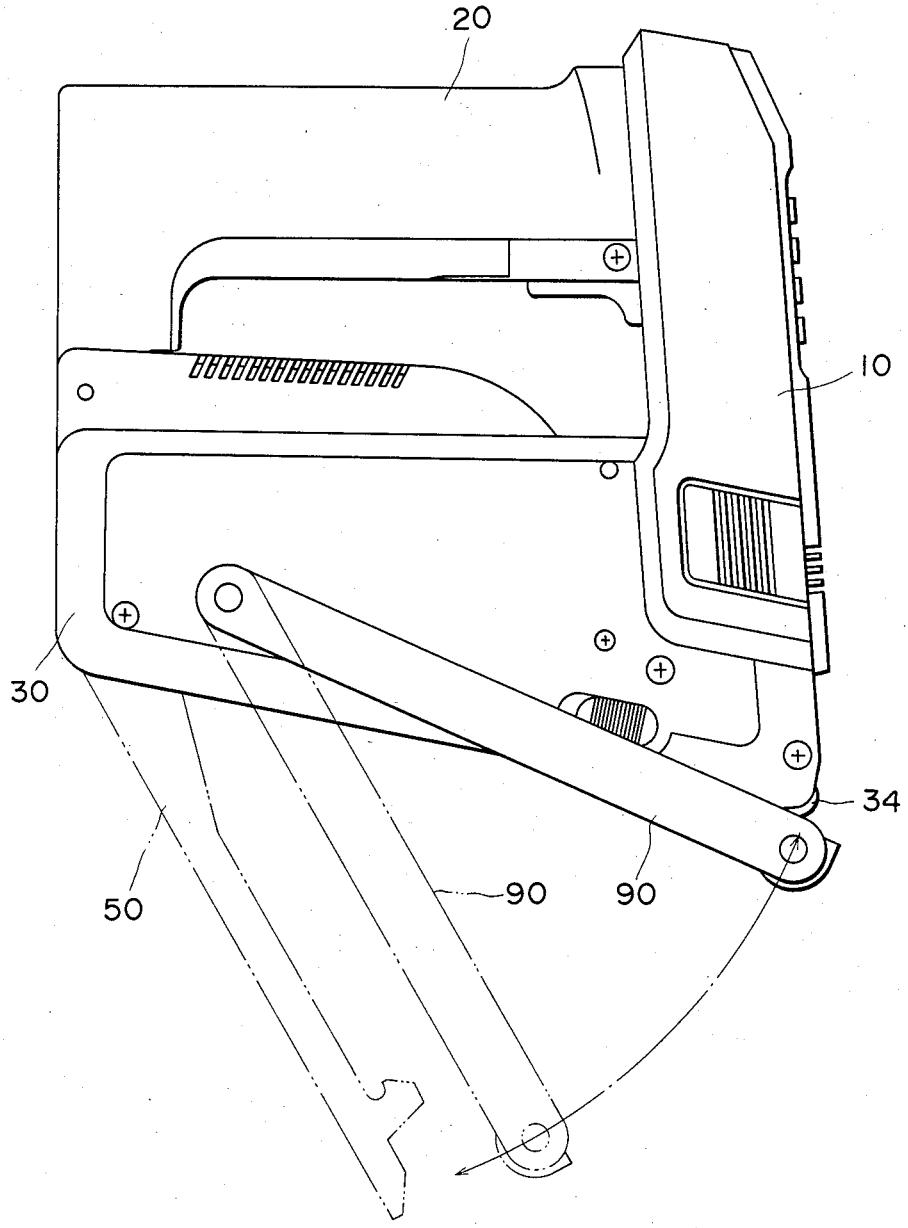
FIG. 17 is a side view of the labeler shown in FIG. 16.

When mounting the attachment 90, the bottom frame 50 can be turned as shown by the broken lines in FIG. 17 so that the extension member 97 of the mounting case 96 is set inside the casing 31 and the bottom frame is closed to fix the extension member 97 inside the casing 31 after setting.

Figure 16:
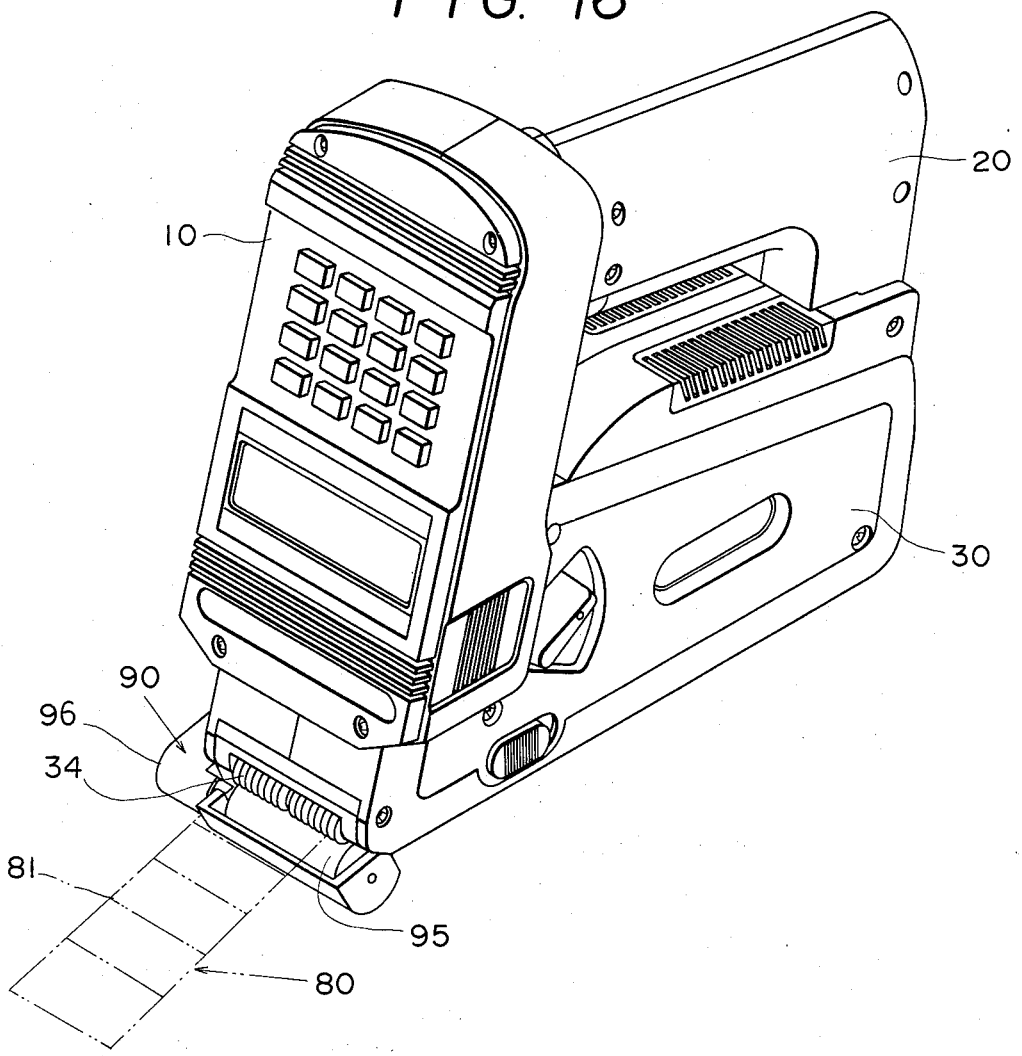
FIG. 16 is a perspective view showing another example of use of the labeler of the present invention.

This attachment 90 is advantageous in that, since the feed roll 95 contacts under pressure the impression roll 34 and can feed the labels 81 with the carrier strip 80 as shown in FIG. 16, the carrier strip 80 with the labels 81 stuck thereon can be inserted between the feed roll 95 and the impression roll 34 rather than turning back the carrier strip 80 around pin 52 and the printed labels stuck to the carrier strip 80 can be obtained or, if this attachment 90 is used, the labeler according to the present invention can be used simply as a printer.

If the attachment 90 is used as described above, an identical printing is made on a number of labels and therefore the labeler is adapted so that the electrical circuit stores input signals and the printing is made on a number of labels in order by turning the switch to ON once.

The mounting case 96 of said attachment 90 is provided with the engaging boss 961 which should be constructed so that said engaging boss 961 engages with the coupling hole 315 of the casing 31 as shown in FIG. 18.

Figure 22:
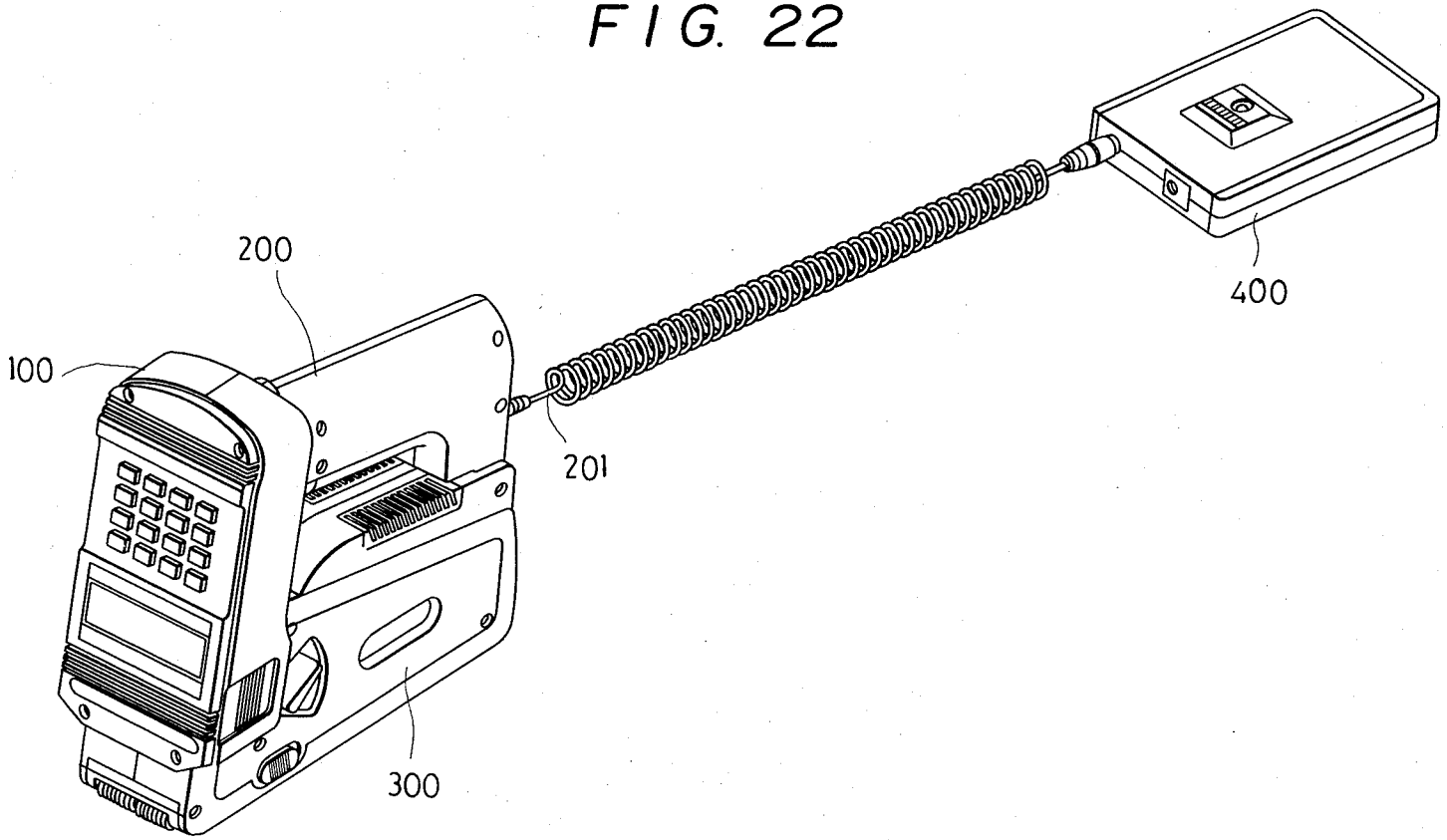
FIG. 22 is a perspective view showing a further embodiment of the labeler of the present invention.

The labeler shown in FIG. 22 is made so that the rechargeable battery housed in the handle in the embodiment shown in FIG. 1 is separately provided outside the housing, or the rechargeable battery 400 is connected with the cord 201 to the labeler body comprising the shell portion 100, the handle 200 and the casing portion 300 and, the battery 400 is held on the waist belt of the user by holding means not shown.

Figure 21:
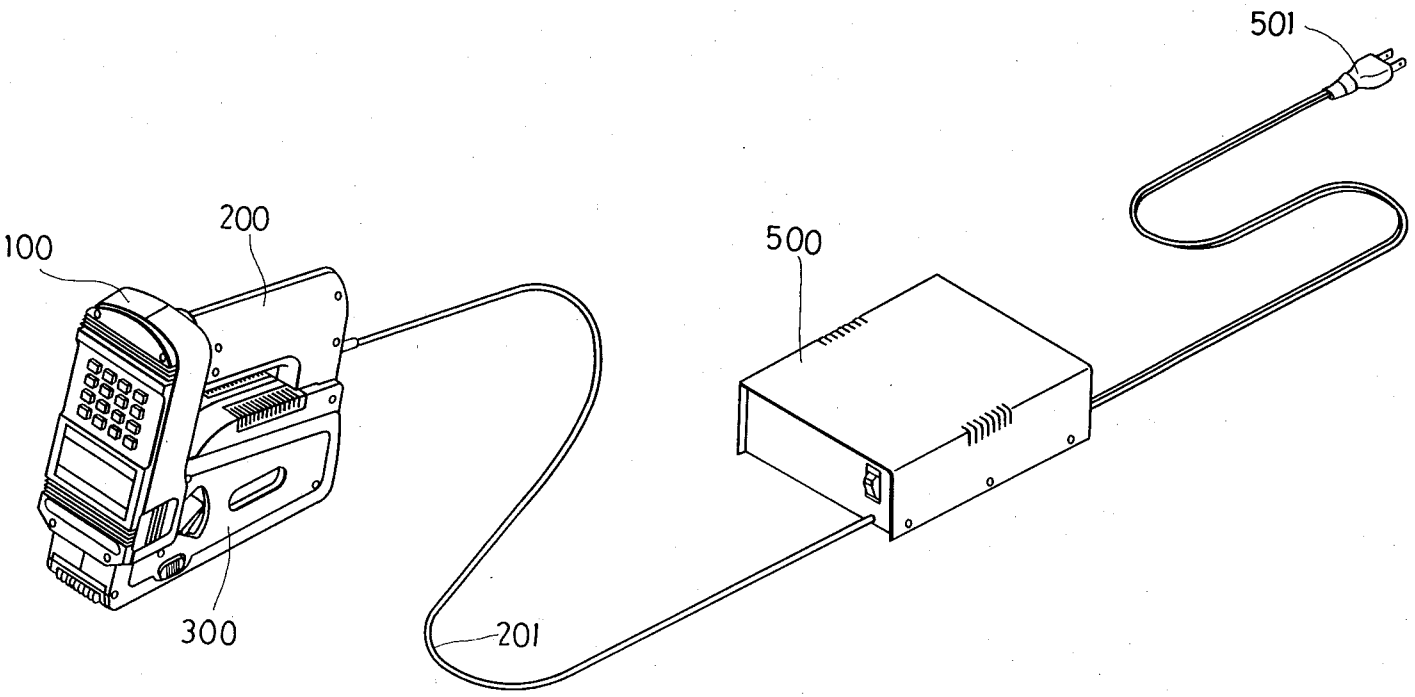
FIG. 21 is a perspective view showing another embodiment of the labeler of the present invention.

The labeler shown in FIG. 21 is made so that the transformer 500 is connected by the cord 201 to said labeler body and simultaneously to the commercial power source by the plug 501 and therefore the labeler body can be freely moved as far as the length of the cord 201.

What is claimed is:

1. An electrically-operated labeler, comprising:

a substantially L-shaped housing having a normally upright shell portion containing substantially all of the electrical operating parts of said labeler and a normally horizontal casing portion extending laterally from the lower end of said upright shell portion and containing substantially all of the mechanical operating parts of said labeler distributed along the length thereof, the dimension of said upright shell portion in the direction of extension of said horizontal casing portion being small relative to the dimension of said horizontal casing portion in the direction of extension thereof;

a handle connected between the free ends of said portions and detachably connected to at least one of said portions;

a keyboard provided on the external surface of said shell portion on the side opposite the side from which said casing portion extends;

an electrical circuit means in said shell portion and connected to said keyboard for receiving and processing input signals from said keyboard;

switching means on said housing and connected to said electrical circuit for operating said electrical circuit;

a holder for holding a roll of label tape constituting one of said mechanical operating parts and provided in said horizontal casing portion;

a turnback means for turning back a carrier strip of the label tape and constituting one of said mechanical operating parts and provided in said horizontal casing portion;

a driving mechanism for feeding said turned back carrier strip in response to a signal from said electrical circuit means and constituting one of the mechanical operating parts and provided in said horizontal casing portion;

an electrical printing means in said housing substantially at the junction between said upright shell portion and said horizontal casing portion for printing on labels in response to a signal from said electrical circuit means; and a power source mounted in said handle.

2. An electrically-operated labeler in accordance with claim 1, wherein said electrical circuit has a display unit for externally displaying input signals.

3. An electrically-operated labeler in accordance with claim 1, wherein said electrical circuit has a microprocessor.

4. An electrically-operated labeler in accordance with claim 1, wherein said power source is a set of dry cells.

5. An electrically-operated labeler in accordance with claim 1, wherein said power source is a rechargeable battery.

6. An electrically-operated labeler, comprising:

a substantially L-shaped housing having a normally upright shell portion containing substantially all of the electrical operating parts of said labeler and a normally horizontal casing portion extending laterally from the lower end of said upright shell portion and containing substantially all of the mechanical operating parts of said labeler distributed along the length thereof, the dimension of said upright shell portion in the direction of extension of said horizontal casing portion being small relative to the dimension of said horizontal casing portion in the direction of extension thereof;

a handle connected between the free ends of said portions;

a keyboard provided on the external surface of said shell portion on the side opposite the side from which said casing portion extends;

an electrical circuit means in said shell portion and connected to said keyboard for receiving and processing input signals from said keyboard;

switching means on said housing and connected to said electrical circuit for operating said electrical circuit;

a holder for holding a roll of label tape constituting one of said mechanical operating parts and provided in said horizontal casing portion;

a turnback means for turning back a carrier strip of the label tape and constituting one of said mechanical operating parts and provided in said horizontal casing portion;

a driving mechanism for feeding said turned back carrier strip in response to a signal from said electrical circuit means and constituting one of the mechanical operating parts and provided in said horizontal casing portion;

an electrical printing means in said housing substantially at the junction between said upright shell portion and said horizontal casing portion for printing on labels in response to a signal from said electrical circuit means; and an external power source connected to said labeler.

7. An electrically-operated labeler in accordance with claim 6, wherein said electrical circuit has a display unit for electrically displaying input signals.

8. An electrically-operated labeler in accordance with claim 6, wherein said electrical circuit has a microprocessor.

9. An electrically-operated labeler in accordance with claim 6, wherein said power source is a set of dry cells.

10. An electrically-operated labeler in accordance with claim 6, wherein said power source is a rechargeable battery.

11. An electrically-operated labeler in accordance with claim 6, wherein said power source is a mains supply.

12. An electrically-operated labeler comprising:

a housing which is an approximate L shape and having an outer shell containing an operating part and a casing containing a mechanical part;

a handle which is provided between the free ends of said housing;

a keyboard provided on the external surface of said operating part;

an electrical circuit which is provided inside said operating part to receive and process input signals from said keyboard;

means for holding a switch to operate said electrical circuit;

a holder provided in said mechanical part for retaining a label tape roll;

a turnback part for turning back a carrier strip of a label tape extending from the label tape roll, a driving mechanism for feeding said turned back carrier strip and separating labels from the carrier strip in response to a signal from said electric circuit;

an electrical printing means in said housing for printing on labels according to a signal from said electrical circuit;

an impression roll in said housing for pressing a label onto an article; and an attachment removably mounted on said housing and having a feed roll which comes in contact under pressure with the impression roll and a transmission means which receives driving power from said driving mechanism and transmits it to said feed roll when said attachment is mounted on said housing.

13. An electrically-operated labeler in accordance with claim 12, wherein said electrical circuit has a display unit for externally displaying input signals.

14. An electrically-operated labeler in accordance with claim 12, wherein said electrical circuit has a microprocessor.

15. An electrically-operated labeler in accordance with claim 12, wherein said attachment has a support member which is secured in the mechanical part.

16. An electrically-operated labeler in accordance with claim 12, further comprising a power source for said labeler and constituted by a set of dry cell batteries.

17. An electrically-operated labeler in accordance with claim 12, further comprising a power source for said labeler and constituted by a rechargeable battery.

* * * * *

UNITED STATES PATENT AND TRADEMARK OFFICE

CERTIFICATE OF CORRECTION

PATENT NO. : 4,826,558

DATED : May 2, 1989

INVENTOR(S) : Tadafuto WADA and Mitsuo FUJITA

It is certified that error appears in the above—identified patent and that said Letters Patent is hereby corrected as shown below:

In the heading, line [73], for "Matsushita Electric Industrial Co, Ltd., Osaka, Japan" should read --Kabushiki Kaisha Shinsei Industries, Tokyo, Japan--.

Signed and Sealed this

Sixth Day of March, 1990

*Attest:*

*Attesting Officer*

JEFFREY M. SAMUELS

*Acting Commissioner of Patents and Trademarks*